US005890044A

United States Patent [19]

Yamashita et al.

[11] Patent Number: 5,890,044

[45] Date of Patent: Mar. 30, 1999

[54] IMAGE FORMING APPARATUS FOR SIMULTANEOUS TRANSFER AND FIXING OF IMAGES

[75] Inventors: Takayuki Yamashita; Tsukasa Matsuda; Yuichi Fukuda; Tetsuo Yamada, all of Nakai-machi, Japan

[73] Assignee: Fuji Xerox Co., Ltd., Tokyo, Japan

[21] Appl. No.: 5,152

[22] Filed: Jan. 9, 1998

[30] Foreign Application Priority Data

Jan. 16, 1997 [JP] Japan ..... 9-005177

[51] Int. Cl.[6] ..... G03G 15/16; G03G 15/20

[52] U.S. Cl. ..... 399/307

[58] Field of Search ..... 399/307, 330, 399/333, 331

[56] References Cited

U.S. PATENT DOCUMENTS 2,990,278 6/1961 Carlson .
5,629,761 5/1997 Theodoulou et al. ..... 399/307

FOREIGN PATENT DOCUMENTS 46-41679 12/1971 Japan .
2-108072 4/1990 Japan .
5-19642 1/1993 Japan .
5-107950 4/1993 Japan .
5-249798 9/1993 Japan .

*Primary Examiner*—S. Lee
*Attorney, Agent, or Firm*—Oliff & Berridge, PLC

[57] ABSTRACT

An image forming apparatus such as a printer and a copying machine, employs a simultaneous transfer and fixing method to obtain a highly lustrous image of high image quality, free of uneven lusterand disordered pixels over the entire density area. Assuming the outside diameter of the convex side roll to be R (mm), the hardness of hardness test of durometer type A and the thickness of the surface layer of the concave side roll to be HR (degree) and dR (mm) respectively, the hardness of hardness test of durometer type A and the thickness of the surface layer of the toner image carrier in contact with the recording medium to be Hb (degree) and db ($\mu$m) respectively, and the nip width to be N (mm), the material and thickness of each surface layer for these two rolls and the intermediate transfer belt are selected so as to satisfy the following relationship:

$$(Hb/HR)>0.8566\ Ln\{(N^2/R)\cdot(db/dR)\}-0.5077$$

where Ln<X> represents natural logarithm of X.

12 Claims, 6 Drawing Sheets

IMAGE FORMING APPARATUS FOR SIMULTANEOUS TRANSFER AND FIXING OF IMAGES

BACKGROUND OF THE INVENTION

1. Technical Field

The present invention relates to an image forming apparatus such as a printer and a copying machine, employing a simultaneous transfer and fixing method for transferring a toner image on a toner image carrier onto a recording medium and fixing the toner image on the recording medium during the transfer.

2. Prior Art

Conventionally, an image forming method has been widely used in which an electrostatic latent image is formed on a photosensitive member, and after it is developed with dry toner, the toner image is electrostatically transferred onto a recording medium for fixing. In such image forming method, paper, which is a recording medium, cannot be brought into tight contact with the photosensitive member completely because of irregularity on the surface of the paper, and uneven gaps are caused, thus causing disordered transfer electric field or Coulomb repulsion between toner themselves. This leads to a problem that the image is blurred.

In order to solve this problem, proposed are an image forming method in which a plurality of toner images having different colors are superposedly transferred electrostatically on an intermediate transfer, member, and after those multi-colored multiple toner images are further melted on the intermediate transfer member, the multiple toner images thus melted are transferred and fixed on a recording medium to obtain a color image, and an image forming method in which a toner image on a photosensitive member formed into the shape of an endless belt is melted, and the toner image thus melted is transferred and fixed on a recording medium to obtain an image. According to the latter method, it is difficult to cause such deteriorated image quality as described above because the toner image is non-electrostatically transferred onto the recording medium.

In such an image forming method, in order to improve the transfer of a toner image onto a recording medium from an intermediate transfer member or a photosensitive member, it is proposed to cool and set the toner while the intermediate transfer member or the photosensitive member, the toner image and the recording medium are laid one on top of another, and thereafter to separate the intermediate transfer member or the photosensitive member from the toner and the recording medium. According to such a method, since the toner sets along the surface of the intermediate transfer member or the photosensitive member, it is possible to obtain a highly lustrous image having a feeling of high grade by smoothing the surface of the intermediate transfer member or the photosensitive member.

In such an image forming method, however, an excellent, uniformly lustrous image without disordered pixels can be obtained at low speed in which sufficient heating time is given, but it has been found that at high speed, in which sufficient heating time is not given, very little uneven luster at a pitch of about 0.3 mm to 2 mm occurs although there is no blurred image. In addition, such uneven luster was not recognized when the intermediate transfer member or the photosensitive member was separated from the toner and the recording medium immediately after the intermediate transfer member or the photosensitive member, the toner and the recording medium are laid one on top of another for heating and compressing as described above.

Such uneven luster is generally known as "microgross unevenness" in fixing. It is known that this phenomenon occurs because the surface of a fixing roll which comes into contact with toner has high hardness, uniform heating and compression are not performed on the toner, but it is unevenly melted. This is solved by making the hardness of the surface the surface of the fixing roll lower.

In the transfer fixing method in which after a multi-colored multiple toner image is melted on an intermediate transfer member or a photosensitive member, the multiple toner image thus melted is transferred onto a recording medium to obtain a color image, when the hardness of the elastic layer on the surface of the intermediate transfer member which comes into contact with the toner is reduced, it was recognized that the uneven luster described above is rather worsened. Problems to be solved by the Invention:

The present invention has been achieved in the light of the above-described problems, and its object is to provide an image forming apparatus, such as a printer and a copying machine, employing a simultaneous transfer and fixing method for transferring a toner image carried on a toner image carrier, such as an intermediate transfer member or a photosensitive member, for carrying a toner image, onto a recording medium and fixing the toner image on the recording medium during the transfer, capable of obtaining a high image quality of image having high glossiness without uneven luster and disordered pixels over the entire area from the highlight area to the medium density portion and the high density portion.

SUMMARY OF THE INVENTION

An image forming apparatus according to the present invention which accomplishes the above-described object is characterized in that in an image forming apparatus comprising:

an endless toner image carrier for carrying a toner image on the surface thereof while circulating, and for conveying the toner image to a predetermined transfer fixing unit;

recording medium conveying means for conveying a recording medium to the transfer fixing unit in synchronism with timing at which the toner image on the toner image carrier is conveyed to the transfer fixing unit; and heating and compression means having, in the transfer fixing unit, a first roll, which comes into contact with the back of the toner image carrier, and a second roll for compressing the toner image carrier and the recording medium, which sandwich the toner image therebetween, between the first roll and the second roll, for heating and compressing the toner image by these first and second rolls, for conveying the recording medium to a predetermined separation position by the toner image carrier while the recording medium, which has passed through a location whereat it is sandwiched between the first and second rolls, is being maintained in a state being in contact with the toner image carrier, and separating the recording medium from the toner image carrier to thereby form an image fixed on the recording medium, the first roll and the second roll have a surface layer respectively, and the toner image carrier has a surface image on the side in contact with the recording medium, in a nip portion formed when the first roll and the second roll are pressed against each other, each diameter, and the material and thickness of each surface layer of the first roll and the second roll are selected so that a plane or a concave surface is formed on a part of the nip portion in the concave side roll of one of the first and second rolls, and assuming the outside diameter of the other convex side roll is different from the concave side roll of the first and second rolls to be R (mm), the hardness of a hardness test of durometer type A and the thickness of the surface layer of the concave side roll to be HR (degree) and dR (mm) respectively, the hardness of a hardness test of durometer type A and the thickness of the surface layer of the toner image carrier in contact with the recording medium to be Hb (degree) and db ($\mu$m) respectively, and the nip width, which is the width of the toner image carrier in the movement direction, of the nip portion to be N (mm), the material and thickness of each surface layer of the first roll, the second roll and the toner image carrier are selected so that the following relation is satisfied:

$$(Hb/HR)>0.8566\ Ln\{(N^2/R)\cdot(db/dR)\}-0.5077$$

where Ln(X) represents the natural logarithm of X.

In the above-described image forming apparatus according to the present invention, the surface layers of the first and second rolls are preferably made of rubber elastic bodies. Also, in the above-described image forming apparatus according to the present invention, the surface layer of the toner image carrier may be made of, for example, rubber elastic body or may be made of resin.

DETAILED DESCRIPTION OF PREFERRED EMBODIMENTS

Herein, the description will mainly be made of an image forming apparatus for transferring and fixing, after once transferring a toner image on a photosensitive member onto an intermediate transfer member, the toner image on the intermediate transfer member onto a recording medium, that is, an image forming apparatus in which the toner image carrier, according to the present invention, is the intermediate transfer member.

In the transfer fixing unit, the intermediate transfer member, the toner image and a sheet, which is the recording medium, are brought into tight-contact with one another in a body and heated to cause the powder toner to enter a melted state, and the individual toner welds together into the form of a sheet of film. At this time, the tight-contact between the intermediate transfer member and the sheet is required to provide efficient heat transfer to the toner image. When this tight-contact is not realized and air enters at places, the thermal capacity differs depending upon a place where there is air or a place where there is no air, and the toner image does not melt uniformly, causing uneven transfer fixing or so-called offset phenomenon to deteriorate the image quality. In order to improve the tight-contact between the intermediate transfer member and the sheet with the toner image interposed therebetween, an elastic body layer is provided on the surface of the intermediate transfer member.

When the intermediate transfer member, the toner and the sheet are pinched and the intermediate transfer member and the sheet are separated immediately after being heated and compressed as described above, no uneven luster was recognized. When the toner is cooled and set with the intermediate transfer member, the toner and the sheet laid one on top of another, and thereafter the intermediate transfer member and the sheet are separated, uneven luster remarkably occurred.

In order to observe what behavior the intermediate transfer member and the sheet show during and after the compression, we viewed the tight-contact state between the sheet and the intermediate transfer member due to pressure using a transparent sheet in place of the sheet, and a transparent roll in place of the compression roll. Then, although the sheet and the intermediate transparent member are uniformly in tight-contact under pressure, it was confirmed that the tight-contact between the two becomes inferior when the pressure is released, and floating portions appeared at places.

Figure 1:
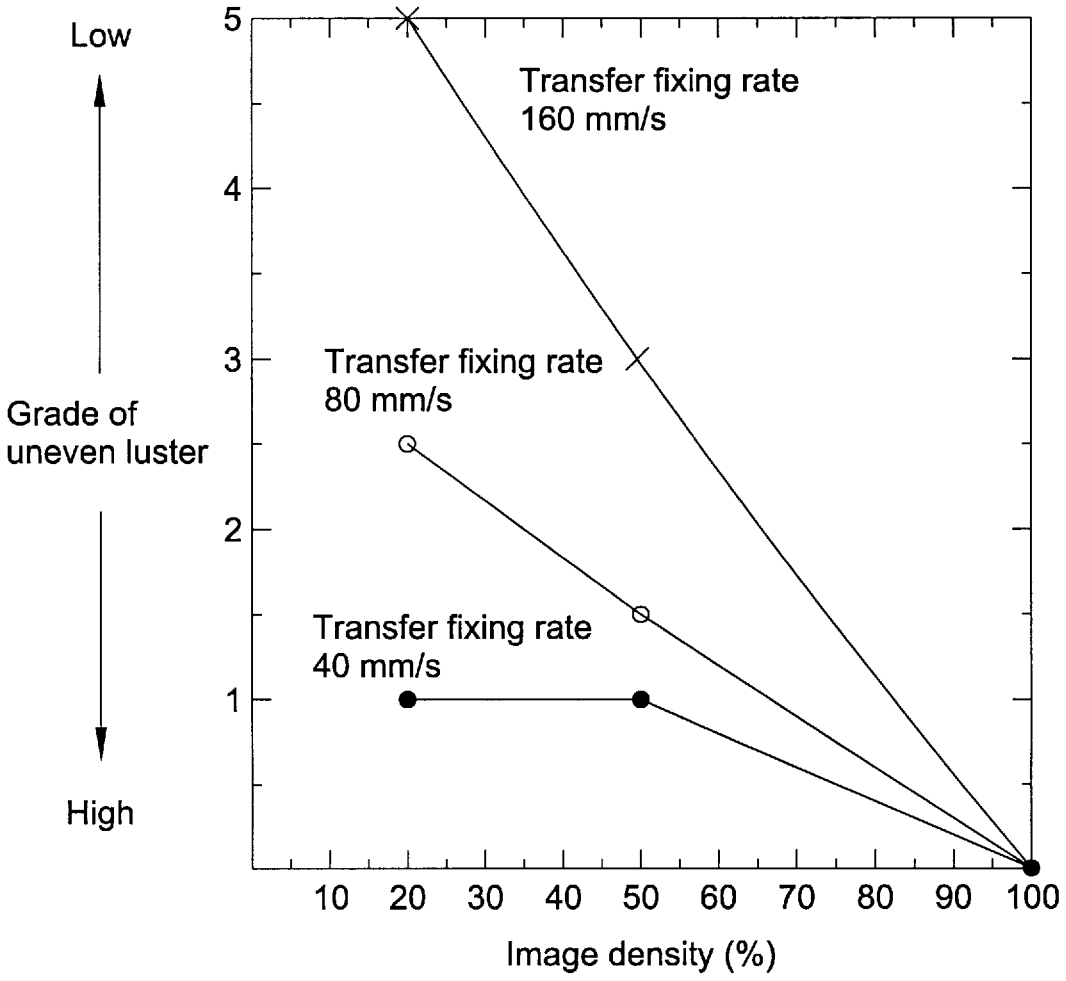
FIG. 1 is a graph showing the relationship between grade of uneven luster, and image density

FIG. 1 shows the relationship between transfer fixing rate and uneven luster. This is obtained by varying the transfer fixing rate and grade evaluating the uneven luster sensuously when the toner is cooled and set with the intermediate transfer member, the toner and the recording medium laid one on top of another, and thereafter the intermediate transfer member is separated from the recording medium. If the grade is not higher than 1, this is a level on which any uneven luster is hardly recognized. FIG. 1 shows that when the transfer fixing rate becomes faster, the uneven luster becomes more inferior as described previously.

FIG. 1 also shows the relationship between image density and uneven luster. This is obtained by varying the image density and grade evaluating the uneven luster sensuously when the toner is cooled and set with the intermediate transfer member, the toner and the recording medium laid one on top of another, and thereafter the intermediate transfer member is separated from the recording medium as in the case of the transfer fixing rate. This figure shows that when the image density becomes lower, the uneven luster becomes more inferior.

When the image surface of a sample in which uneven luster occurs is observed with a scanning electron microscope (SEM), the highly lustrous place has a smooth surface, while the low lustrous place has an undulating surface.

From the above results, the present inventor has conjectured that the following conduces to this uneven luster.

In the transfer fixing area where the intermediate transfer member, the toner and the recording medium are pinched for heating and compressing, the pressure deforms the elastic layer of the intermediate transfer member, the toner and the sheet to bring them into tight contact. Particularly after the pressure is released, the tight contact becomes inferior, and the amounts of deformation in the elastic layer of the intermediate transfer member and the toner are great in floating portions.

After the pressure is released, the elastic layer of the intermediate transfer member and the toner are restored by their elastic characteristics. Since the elastic layer of the intermediate transfer member is an elastic body, the amount of restoration is equal to the amount of deformation. Since, however, the toner is a visco-elastic body, a part of the deformation remains as permanent strain, and the magnitude of the strain is proportional to the amount of deformation. To that end, when great deformation occurs under pressure, the difference in the amount of restoration between the elastic body of the intermediate transfer member and the toner when the pressure is released becomes great, thus causing a gap between the elastic body of the intermediate transfer member and the toner. Particularly, in such a portion as to float due to inferior tight-contact after the pressure is released, the amount of deformation is great to easily cause a gap. In the low density area having a small amount of toner and a thin toner layer, a gap easily occurs because of a great amount of deformation in the elastic body of the intermediate transfer member.

When the intermediate transfer member and the sheet are cooled while they are in contact with each other after the pressure is released, the place where there occurs a gap and the sheet is separated from the elastic body of the intermediate transfer member, has an undulated shape with the toner not set following the surface of the intermediate transfer member. On the other hand the tight contact portion sets and has a smooth surface following the surface of the intermediate transfer member. Thus, the smooth surface becomes highly lustrous, and the undulated surface becomes low lustrous, causing uneven luster.

The reason why the uneven luster becomes remarkable when the transfer fixing rate becomes faster is conjuctured to be as follows:

Usually, in the case of high speed, the temperature of the heating roll is set high, whereby the temperature gradient within the intermediate transfer member, the toner and the sheet is made high to supplement the insufficient heating time. When, however, the temperature gradient within the toner layer is made high, the low temperature portion is at the toner melt temperature which is the lowest temperature required for transfer fixing. However, the high temperature portion is at a much higher temperature than the toner melt temperature, and the toner viscosity becomes very low. Namely, the elastic property of the toner, which is a visco-elastic body, becomes low, and the restoring force becomes low. To that end, the gap between the elastic body of the intermediate transfer member and the toner becomes prone to occur as compared with low speed in which the temperature gradient within the toner layer is low, thus causing remarkable uneven luster.

As described above, it is conjectured that the occurrence of a gap between the elastic body of the intermediate transfer member and the toner after the transfer fixing unit is passed, conduces to the uneven luster. Namely, the reason is that the elastic body of the intermediate transfer member and the toner deform at the transfer fixing unit, and there occurs a difference in the amount of restoration between the elastic layer of the intermediate transfer member and the toner when the pressure is released after the transfer fixing unit is passed.

Usually, the transfer fixing unit is composed of a heating roll having a heat source such as a halogen lamp within, and a compression roll for sandwiching the intermediate transfer member, the toner image and the sheet between the heating roll and the compression roll for pressing, and the applied pressure is preferably within a range of $1\times10^5$ Pa to $1\times10^6$ Pa. If the pressure is lower than this range, the tight-contact between the intermediate transfer member, the toner and the sheet will be insufficient so that the toner does not permeate through the sheet, but the fixing strength becomes insufficient, thus deteriorating the image quality.

Generally, the pressure at the transfer fixing unit depends upon the amounts of strain and the hardness of the surface elastic bodies of two rolls for urging against each other with the intermediate transfer member, the toner image and the sheet interposed therebetween.

Figure 2:
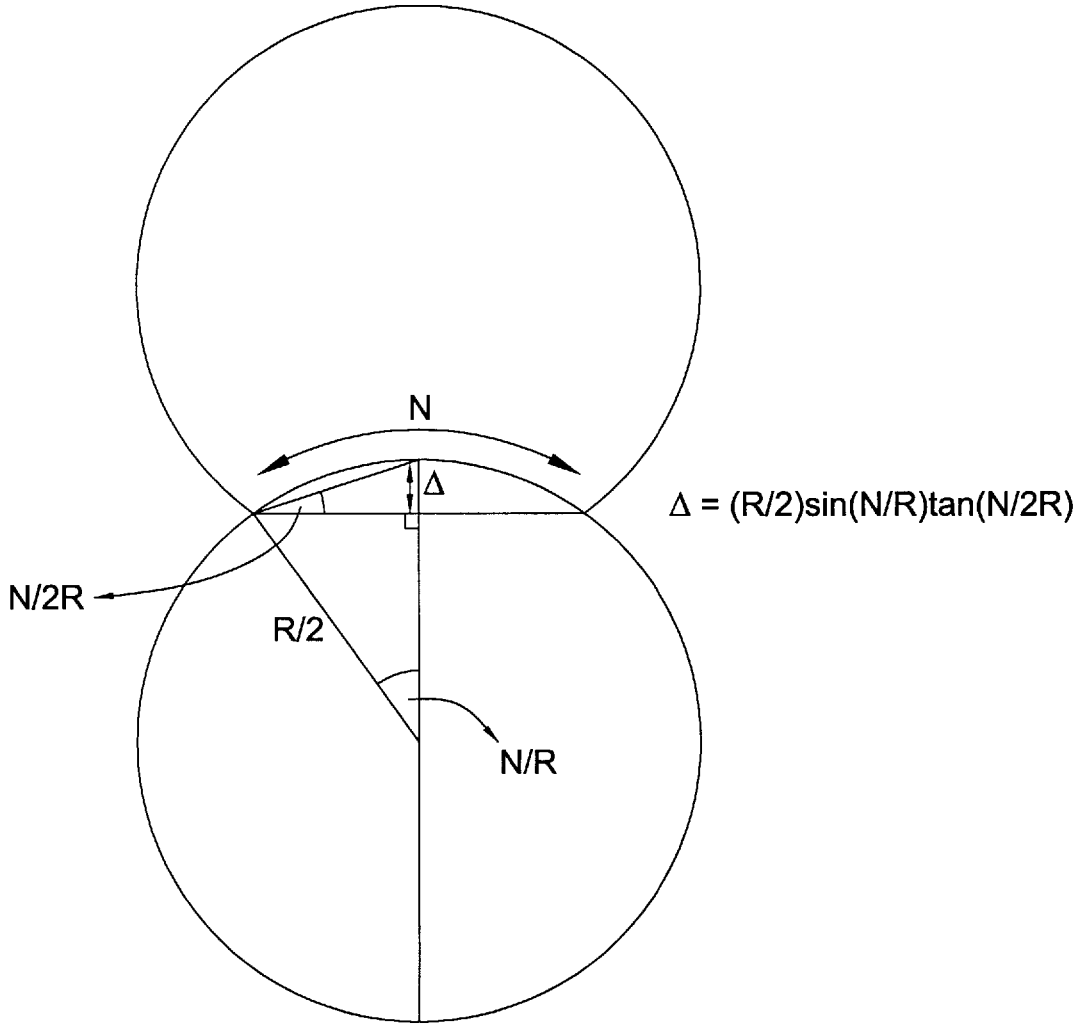
FIG. 2 is a view schematically showing a state in which one roll eats into the other roll to form a nip portion.

In the transfer fixing unit, one of two rolls usually eats into the other roll to form a nip as shown in FIG. 2. At this time, by solving a simple geometric problem, the amount of deformation Δ shown in FIG. 2 is given by the following equation:

$$\Delta=(R/2)\sin(N/R)\times\tan(N/2\ R) \quad (1)$$

where R is the outside diameter (mm) of the eating-in roll (lower roll in FIG. 2), and N is the nip length (mm). Since generally $N/R<0.15$ when the applied pressure is within a range of $1\times10^5$ Pa to $1\times10^6$ Pa, the following equation (1') is given from equation (1) using approximate expressions at a small angle, $\sin\theta=\theta$ and $\tan\theta=\theta$.

$$\Delta=N^2/4\ R \quad (1')$$

Therefore, the pressure P in the transfer fixing unit is represented by the following equation (2) according to Hooke's law.

$$P\propto\Delta\times HR/dR\propto N^2/R\times HR/dR \quad (2)$$

where HR is the hardness of the roll (upper roll in FIG. 2) which is eaten in, and dR is the thickness (mm) of the elastic body on the surface of the roll which is eaten in.

In this respect, the present invention employs the hardness measured by the durometer hardness test using a durometer type A in the JIS K $6253_{-1993}$ "Vulcanized Gum Hardness Testing Method".

On the other hand the amount of deformation dL in the elastic body of the intermediate transfer member depends upon the pressure P in the transfer fixing unit, the hardness Hb of the elastic body of the intermediate transfer member, and the thickness db (μm) of the elastic body of the intermediate transfer member.

Using equation (2), dL is represented by the following equation (3).

$$dL\propto N^2/R\times HR/dR\times db/Hb \quad (3)$$

On the basis of the foregoing consideration, the present inventor performed experiments by combining the following:

N=3, 6, 9 mm

R=30, 50, 80 mm

HR=30, 50, 60 degrees

Hb=10, 30, 40, 50, 70 degrees dR=1, 2, 3 mm db=10, 30, 50, 100 μm

Transfer fixing rate =80 mm/s, 120 mm/s, 160 mm/s to evaluate the uneven luster, and if any minor unevenness is recognized, it was regarded as failure (X).

Figure 3:
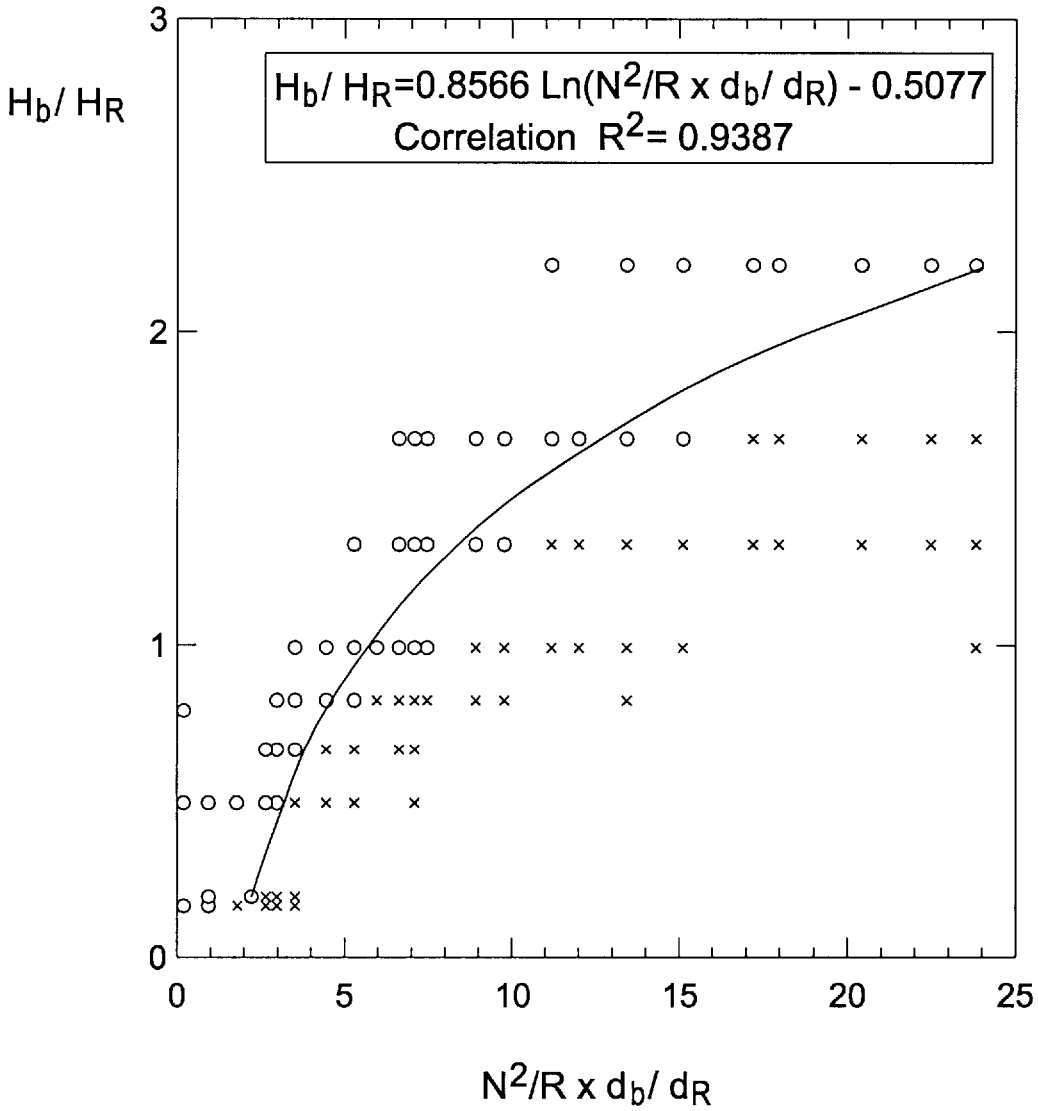
FIG. 3 is a view showing the evaluation results for uneven, luster.

FIG. 3 is obtained by plotting this on the relationship between Hb/HR and $N^2/R\times db/dR$ in accordance with the relationship shown in equation (3).

From this result, the present inventor found that an allowable line, in which the evaluation result shifts from ○ to X, well correlates with the logarithmic regression. This regression equation is given by:

$$(Hb/HR)>0.8566\ Ln\{(N^2/R)\cdot(db/dR)\}-0.5077$$

where Ln<X> represents natural logarithm of X.

From the foregoing, it can be seen that the relationship between roll hardness HR, thickness dR, outside diameter R, hardness Hb of elastic body of intermediate transfer member, thickness db, and nip length N, in which a good image can be obtained without causing any uneven luster, is given by:

$$(Hb/HR)>0.8566\ Ln\{(N^2/R)\cdot(db/dR)\}-0.5077 \quad (4)$$

Figure 4:
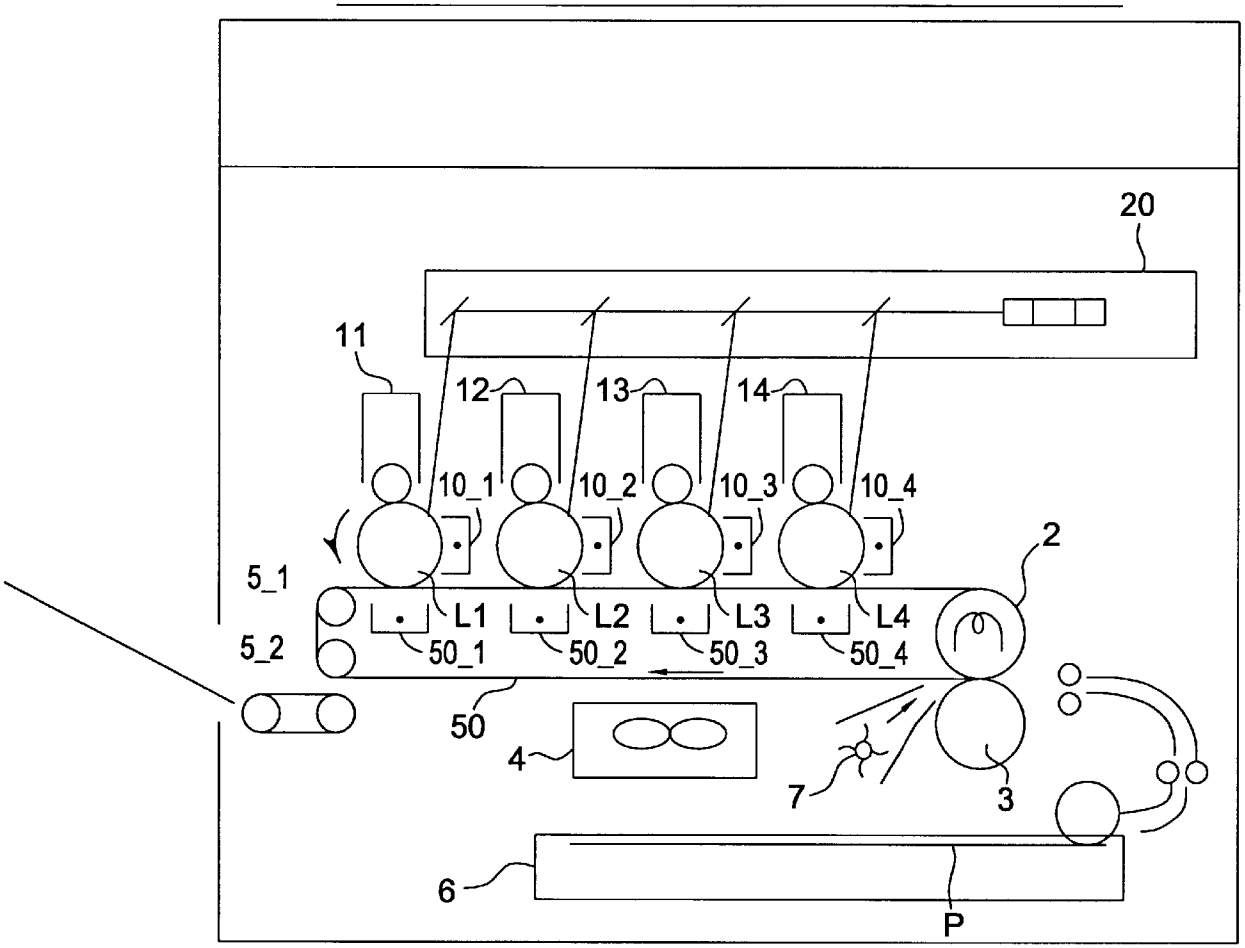
FIG. 4 is a view schematically showing a first embodiment of an image forming apparatus according to the present invention.

FIG. 4 is a structural view showing a first embodiment of an image forming apparatus according to the present invention.

In FIG. 4, a belt-shaped intermediate transfer member 50 is supported by rollers 5-1, 5-2 and a heating roll 2 to rotate in a direction indicated by an arrow. A compression roll 3 is arranged facing to the heating roll 2. The heating roll 2 and the compression roll 3 can be reversely arranged, and the compression roll 3 may be used as a heating roll having a heat source therein. In the periphery of the intermediate transfer member 50, there are arranged four photosensitive members 1-1, 1-2, 1-3, and 1-4, and after it is uniformly charged by chargers 10-1, 10-2, 10-3, and 10-4 respectively, each photosensitive member is exposed by a light beam scanning device 20 which scans a light beam turned ON or OFF in response to a density signal to form an electrostatic latent image on each photosensitive member. The electrostatic latent image on each photosensitive member is developed by developer units 11, 12, 13, and 14 containing black, yellow, magenta, and cyan colors of toner respectively to form, on each photosensitive member, each color toner image of so-called digital image representing the density by area modulation. Each each color toner image is transferred onto the intermediate transfer member 50 in order by transfer units 50-1, 50-2, 50-3, and 50-4 to form plural colors of toner images on the intermediate transfer member 50.

The compression roll 3 abuts upon the heating roll 2 under pressure as a recording sheet P is fed from a tray 6. Thereafter, the intermediate transfer member 50 holding the plural colors of toner images and the recording sheet P are moved between the heating roll 2 and the compression roll 3 with the timing synchronized to be compressed and heated. The toner heated not lower than the melt temperature is softened and melted to permeate through the recording sheet P, and thereafter set to thereby perform transfer and fixing. A cooling device 7 at the outlet of the heating area and a cooling device 4 are used to cool the intermediate transfer member 50 and the recording sheet P, which are fed in a body from the heating area, and the cooling causes the toner to agglomerate and set, thus causing a strong adhesive force to the recording sheet P. The intermediate transfer member 50 and the recording sheet P cooled by the cooling device 4 are further fed, and the recording sheet P is separated from the intermediate transfer member 50 together with the toner by the stiffness of the recording sheet P itself at the roll 5-2 with a small curvature radius to form a color image on the recording sheet P. The surface of the toner image transferred and fixed on the recording sheet P is smoothed following the surface of the intermediate transfer member 50 to become highly lustrous.

As the photosensitive members 1-1, 1-2, 1-3, and 1-4, various organic photosensitive members can be used in addition to various inorganic photosensitive members (such as Se, a-Si, a-SiC, and CdS).

The toner is composed of thermoplastic binders containing dyestuffs of yellow, magenta, cyan, and the like, and known materials can be used. In this embodiment, there was used toner having weight-average molecular weight (Mw) of 54,000, melt temperature (Tm) of 120° C., and viscosity (η) at the melt temperature of 4,000 Pas. In this respect, toner having an average particle diameter of 7 μm was used. The exposure condition or development condition is set so that the amount of toner for each color on the recording sheet P becomes approximately 0.4 mg/cm$^2$ to 0.7 mg/cm$^2$ according to the content of the dyestuff. In this embodiment, it was set to 0.65 mg/cm$^2$ for each color.

Figure 6:
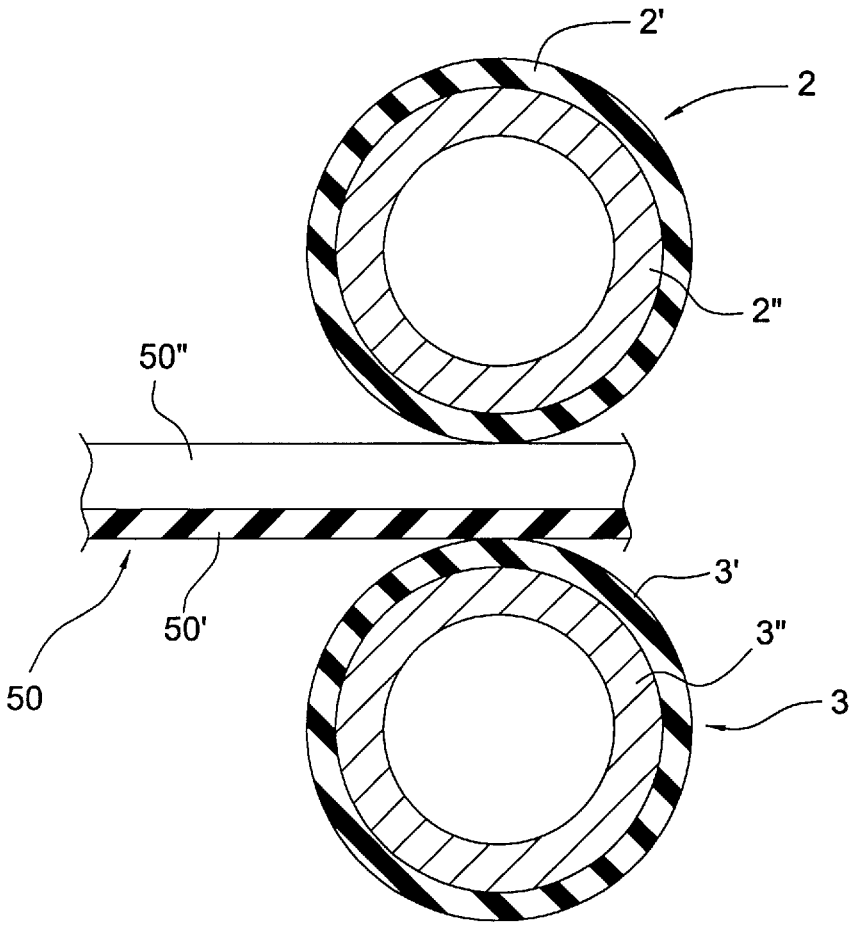
FIG. 6 is a partial cross-sectional view of the intermediate transfer member, heating roll and compression roll of the image forming apparatus shown in FIG. 4.

For the intermediate transfer member 50, an intermediate transfer member having two-layer structure consisting of a base layer 50 and a surface layer 50 as shown in FIG. 6 was used. For the base layer, polyimide film with a thickness of 70 μm added with carbon black was used. In this embodiment, in order to electrostatically transfer the toner image from the photosensitive member onto the intermediate transfer member without blurred image, the volume resistivity of the base layer was adjusted to $10^{10}$ Ωcm by varying the amount of carbon black added. In this respect, as the base layer, it is possible to use, for example, a high heat-resistant sheet with a thickness of 10 to 300 μm, and to use a polymer sheet such as polyester, polyethylene terephthalate, polyether sulfone, polyether ketone, polysulfone, polyimide, polyimide amide and polyamide.

As regards the surface layer, in order to electrostatically transfer the toner image from the photosensitive member onto the intermediate transfer member without blurred image, its volume resistivity was adjusted to $10^{14}$ Ωcm, and on performing simultaneous transfer and fixing from the intermediate transfer member to the sheet, there were used silicone copolymer having rubber hardness of 10, 30, 40, 50, and 70 degrees and thicknesses of 10, 30, 50, and 100 μm respectively in order to improve the tight-contact between the intermediate transfer member and the sheet with the toner image interposed therebetween. The silicone copolymer has elasticity, its surface shows the tackiness to toner at normal temperatures, and further has characteristic properties to facilitate separation of the toner, which has been melted and fluidized in order to effectively move it to the recording medium. Therefore, it is optimal for the surface layer.

Referring to FIG. 6, the heating roll 2 and the compression roll 3, for example, can comprise a metal roll or a metal roll 2", 3", respectively, with a heat-resisting (surface) layer 2', 3', respectively, made of silicone rubber or the like formed thereon used. A heat source is arranged within the heating roll, and its heating temperature is set and controlled so that the toner temperature in the heating area exceeds the toner melt temperature (Tm). In this embodiment, there were used a heating roll with an outside diameter of 50 mm, prepared by stacking 1 mm, 2 mm, and 3 mm thick-silicone silicone rubber layers, the layers having hardness of 30, 50, and 60 degrees respectively on a hollow roll made of aluminum, and compression rolls with an outside diameter of 30, 50, and 80 mm respectively, prepared by stacking a 1 mm-thick silicone rubber layer having hardness of 50 degrees on a hollow roll made of aluminum. As the heat source within the heating roll, a halogen lamp was used. The pressing force for both heating and compression rolls was varied and adjusted so that the nip length was 3, 6, and 9 mm.

For the recording sheet P, paper J manufactured by Fuji Xerox Co., Ltd. was used as ordinary paper, and for surface smooth paper, coated paper J-coat manufactured by Fuji Xerox Co., Ltd. was used. The measured value for the ten-point average roughness SRz of the surface of the paper J using a contact-type three-dimensional surface roughness meter is about 20 μm, and the ten-point average roughness SRz for the surface of J-coat paper is 5 μm.

For the screen, vertical line screen was used, and the number of-lines was 200.

With the arrangement described above, the conveying speed (transfer fixing rate) of the intermediate transfer member and the toner image is 80, 120, and 160 mm/s, roll hardness HR, thickness dR, outside diameter R, hardness Hb of elastic body of the intermediate transfer member, thickness db, and nip length N are combined within the above-described range to output an image on surface smooth paper (paper J-coat) for evaluating the uneven luster, and to plot it on the relationship between (Hb/HR) and $\{(N^2/R)\times(db/dR)\}$·The result is as shown in FIG. 3 described already.

The uneven luster was evaluated by judging whether or not it can be perceived by visual inspection. From this result, it can be seen that in order to obtain uneven luster on an allowable level for a certain $\{(N^2/R)\cdot(db/dR)\}$, it is necessary to exceed a certain (Hb/HR) which is determined correspondingly to $\{(N^2/R)\cdot(db/dR)\}$.

This result is as described previously, and when logarithmic regression is performed for the allowable line in which the evaluation result shifts from ○ to X, the following is given:

$$(Hb/HR)=0.8566Ln\{(N^2/R)\cdot(db/dR)\}-0.5077$$

From the foregoing, it can be seen that the relationship between roll hardness HR, thickness dR, outside diameter R, hardness Hb of elastic body of the intermediate transfer member, thickness db, and nip length N, in which a good image can be obtained without causing any uneven luster is given by:

$$(Hb/HR)>0.8566\ Ln\{(N^2/R)\cdot(db/dR)\}-0.5077 \quad (4)$$

When the roll hardness HR, the thickness dR, the outside diameter R, the hardness Hb of elastic body of the intermediate transfer member, the thickness db, and the nip length N are adjusted so as to satisfy the equation (4), and an image is outputted on ordinary paper (paper J) at the above-described transfer fixing rates, a good image without uneven luster could be obtained at any of the transfer fixing rates.

Figure 5:
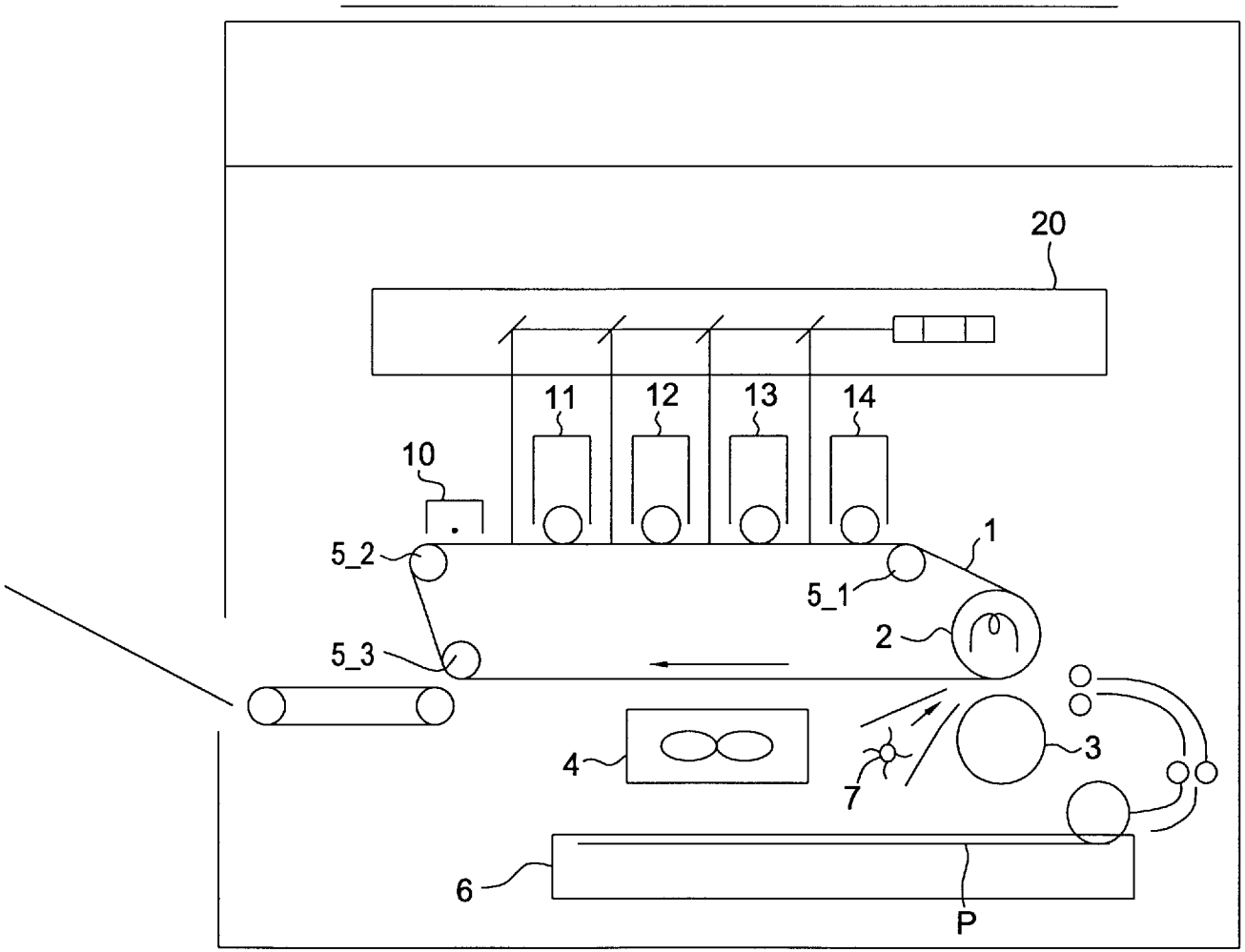
FIG. 5 is a view schematically showing a second embodiment of an image forming apparatus according to the present invention.

FIG. 5 is a structural view showing a second embodiment of an image forming apparatus according to the present invention.

In FIG. 5, a belt-shaped photosensitive member 1 is supported by rollers 5-1, 5-2, and 5-3 and a heating roll 2 to rotate in a direction indicated by an arrow. A compression roll 3 is arranged facing to, and apart from the heating roll 2. The heating roll 2 and the compression roll 3 can be reversely arranged, and the compression roll 3 may be used as a heating roll having a heat source therein. After it is uniformly charged by a charger 10, the photosensitive member 1 is exposed by a light beam scanning device 20 which scans a light beam, which is turned ON or OFF in response to a density signal, to form an electrostatic latent image on the photosensitive member 1. The electrostatic latent image on the photosensitive member 1 is developed by a developer unit 11 to form, on the photosensitive member 1, a toner image of so-called digital image representing the density by area modulation. Developer units 11, 12, 13, and 14 contain black, yellow, magenta, and cyan colors of toner respectively, and the repetition of the charging, exposure, and development described above causes toner images of plural colors to be formed on the photosensitive member 1.

The compression roll 3 abuts upon the heating roll 2 under pressure as a recording sheet P is fed from a tray 6. Thereafter, the photosensitive member 1 holding the plural colors of toner images and the recording sheet P are moved between the heating roll 2 and the compression roll 3 with the timing synchronized to be compressed and heated. The toner heated not lower than the melt temperature is softened and melted to permeate through the recording sheet P, and thereafter sets to thereby perform transfer and fixing. After being cooled by a cooling device 7 at the outlet of the heating area and a cooling device 4, the photosensitive member 1 and the recording sheet P are further conveyed, and the recording sheet P is separated from the photosensitive member 1 together with the toner by the strength of body of the recording sheet P itself at the roll 5-3 with a small curvature radius to form a color image on the recording sheet P. The surface of the toner image transferred and fixed on the recording sheet P is smoothed following the surface of the photosensitive member 1 to become highly lustrous.

As the photosensitive member 1, various photosensitive members (such as Se, a-Si, a-SiC, and Cds) having heat-resisting property can be used.

For the toner, the same toner as used in the first embodiment was used, and the amount of toner for each color on the recording sheet was also set to 0.65 mg/cm$^2$, which is the same as in the first embodiment.

For the heating roll and the compression roll, the same rolls as in the first embodiment were used.

For the recording sheet P, coated paper J-row coat manufactured by Fuji Xerox Co., Ltd. was used.

For the screen, vertical line screen was used, and the number of lines was set to 200 as in the first embodiment.

With the arrangement described above, the conveying speed (transfer fixing rate) of the photosensitive member and the toner image is 80, 120, and 160 mm/s, the roll hardness HR, the thickness dR, the outside diameter R, the surface hardness Hb of the photosensitive member, the thickness db, and the nip length N are adjusted so as to satisfy equation (4) to output an image on surface smooth paper (paper J-coat) at the above-described transfer fixing rates. As a result, a good image free of uneven luster could be obtained at any of the transfer fixing rates.

Referring to FIG. 4 again, another embodiment and example will be described. Herein, the photosensitive member, the charger, the light beam scanning device, the developer unit, and the transfer unit are the same as in the first embodiment which has been described referring to FIG. 4 and the description thereof is omitted.

For the intermediate transfer member 50, an intermediate transfer member having two-layer structure consisting of a base layer and a surface layer was used as in the first embodiment. The base layer is the same as in the first embodiment, and the description thereof is omitted.

In order to electrostatically transfer a toner image onto the intermediate transfer member from the photosensitive member without any blurred image, the volume resistivity of the surface layer of the intermediate transfer member was adjusted to $10^{14}\Omega$cm, and polytetrafluoroethylene having hardness of 70 degrees and a thickness of 10 μm was used.

As the heating roll and the compression roll, as in the first embodiment, there were used a heating roll with an outside diameter of 50 mm prepared by stacking a 3 mm-thick silicone rubber sheet with hardness of 60 degrees on a hollow roll made of aluminum, and a compression roll with an outside diameter of 50 mm prepared by stacking a 1 mm-thick silicone rubber sheet with hardness of 50 degrees on a hollow roll made of aluminum. As the heat source within the heating roll, a halogen lamp was used. The pressing force between the heating and compression rolls was varied and adjusted so that the nip length is 6 mm.

Therefore, $$Hb/HR=60/50=1.17$$

$$N^2/Rxdb/dR=6^2/50\times10/3=2.4$$

$$0.8566\ Ln\{(N^2/R)\cdot(db/dR)\}-0.5077=0.24$$

Accordingly, $$(Hb/HR)>0.8566\ Ln\{(N^2/R)\cdot(db/dR)\}-0.5077,$$

satisfying the equation (4).

With the arrangement described above, when the conveying speed of the intermediate transfer member and the toner image is 160 mm/s, an image was outputted on surface smooth paper (paper J-coat) at the above-described number of lines to evaluate the uneven luster.

As a result, a good image free of uneven luster could be obtained.

As described above, according to an image forming apparatus of the present invention, it is possible to obtain a highly lustrous image of high image quality, free of uneven luster and disordered pixels over the entire area from the highlight area to the medium density portion and the high density portion.

What is claimed is:

1. An image forming apparatus, comprising:

an endless toner image carrier carrying a toner image;

a recording medium;

transfer fixing means for bringing said recording medium into contact with the toner image on said toner image carrier, heating said toner image, and transferring and fixing said toner image on said recording medium;

said toner image carrier having a surface layer on a side in contact with said recording medium;

said transfer fixing means having a first rotator which comes into contact with a back of said toner image carrier, and a second rotator for compressing said toner image carrier and said recording medium with said toner image interposed between said first rotator and said second rotator, said first rotator and said second rotator each having a heat-resisting layer on a respective surface; and a hardness of at least one of the heat-resisting layers of said first rotator and said second rotator being equal to or lower than a hardness of the surface layer of said toner image carrier.

2. An image forming apparatus as defined in claim 1, wherein the surface layer of said toner image carrier is elastic.

3. An image forming apparatus as defined in claim 2, wherein the surface layer of said toner image carrier is composed of silicone copolymer.

4. An image forming apparatus as defined in claim 2, wherein the surface layer of said toner image carrier is composed of fluoro rubber.

5. An image forming apparatus as defined in claim 1, wherein the heat-resisting layer of at least one of said first rotator and said second rotator is elastic.

6. An image forming apparatus as defined in claim 5, wherein the heat-resisting layer of at least one of said first rotator and said second rotator that is elastic is composed of rubber elastic bodies.

7. An image forming apparatus, comprising:

an endless toner image carrier which moves in a predetermined direction and carries a toner image;

a recording medium;

transfer fixing means for bringing said recording medium into contact with the toner image on said toner image carrier, heating said toner image, and transferring and fixing said toner image on said recording medium;

said toner image carrier having a surface layer on a side in contact with said recording medium, said transfer fixing means having a first roll which comes into contact with a back of said toner image carrier, and a second roll for compressing said toner image carrier and said recording medium with said toner image interposed between said first roll and said second roll, said first roll and said second roll each having a heat-resisting layer on a surface respectively, and a material and thickness of each heat-resisting layer of said first roll and said second roll and said surface layer of said toner image carrier satisfy the following relationship:

$$(Hb/HR)>0.8566Ln\{(N^2/R)\cdot(db/dR)\}-0.5077$$

where Ln{X} represents the natural logarithm of X, assuming an outside diameter of a roll having a heat-resisting layer of the first roll and said second roll to be R (mm), a hardness determined by a durometer type A hardness test and a thickness of the heat-resisting layer of the other roll of said first and second rolls, which is different from the roll having said heat-resisting layer with higher hardness, to be HR (degree) and dR (mm) respectively, a hardness determined by the durometer type A hardness test and a thickness of the surface layer of said toner image carrier to be Hb (degree) and db ($\mu$m) respectively, and a nip width, equal to a length of said toner image carrier in the predetermined direction, of a nip portion which is formed when said first roll and said second roll are pressed against each other, to be N (mm).

8. An image forming apparatus as defined in claim 7, wherein the surface layer of said toner image carrier is elastic.

9. An image forming apparatus as defined in claim 8, wherein the surface layer of said toner image carrier is composed of silicone copolymer.

10. An image forming apparatus as defined in claim 8, wherein the surface layer of said toner image carrier is composed of fluoro rubber.

11. An image forming apparatus as defined in claim 7, wherein the heat-resisting layer of at least one of said first roll and said second roll is elastic.

12. An image forming apparatus as defined in claim 11, wherein the heat-resisting layer of said first roll and said second roll that is elastic is composed of rubber elastic bodies.

* * * * *